US007098636B2

(12) United States Patent
Koerner et al.

(10) Patent No.: US 7,098,636 B2
(45) Date of Patent: Aug. 29, 2006

(54) VOLTAGE REGULATOR CIRCUIT

(75) Inventors: Gotthilf Koerner, Weissach (DE); Tomas Geffke, Eningen (DE)

(73) Assignee: Robert Bosch GmbH, (DE)

( * ) Notice: Subject to any disclaimer, the term of this patent is extended or adjusted under 35 U.S.C. 154(b) by 0 days.

(21) Appl. No.: 10/712,119

(22) Filed: Nov. 12, 2003

(65) Prior Publication Data

US 2004/0100231 A1 May 27, 2004

(30) Foreign Application Priority Data

Nov. 25, 2002 (DE) ..... 102 54 821

(51) Int. Cl.
*G05F 1/40* (2006.01)

(52) U.S. Cl. ..... 323/268; 323/271; 323/273

(58) Field of Classification Search ..... 323/265, 323/271, 273, 268; 320/150, 152, 153; 322/28, 322/33, 34

See application file for complete search history.

(56) References Cited

U.S. PATENT DOCUMENTS

| | | | | |
|---|---|---|---|---|
| 4,611,162 A | | 9/1986 | Erratico et al. | |
| 4,629,967 A | * | 12/1986 | Voss | 322/28 |
| 5,083,078 A | | 1/1992 | Kubler et al. | |
| 5,122,727 A | | 6/1992 | Janssen et al. | |
| 5,592,072 A | * | 1/1997 | Brown | 323/271 |
| 6,249,110 B1 | | 6/2001 | Geyer et al. | |
| 6,661,210 B1 | * | 12/2003 | Kimball et al. | 323/273 |

FOREIGN PATENT DOCUMENTS

| | | |
|---|---|---|
| DE | 29 33 029 | 2/1980 |
| DE | 40 15 351 | 11/1991 |
| DE | 198 38 003 | 3/2000 |
| DE | 199 17 204 | 10/2000 |

OTHER PUBLICATIONS

Koetsch, P., "Current-mode control lets a power supply be parallel for expansion, redundancy," Nov. 14, 1985, pp. 125-132, vol. 33, Electronic Design.

* cited by examiner

*Primary Examiner*—Jessica Han
(74) *Attorney, Agent, or Firm*—Kenyon & Kenyon LLP

(57) ABSTRACT

A circuit system for generating a stabilized power supply voltage, which, on the basis of a temperature quantity, selects an operating mode of a voltage regulator. In this context, it is provided, in particular, to apply the principles of the present invention to the supplying of voltage to electronic consumers in motor vehicles. During operation of the voltage regulator, a temperature quantity is recorded which is indicative of a quantity representing or influencing the operation of the voltage regulator. During active operation, the voltage regulator can be operated in at least two operating modes, and the current operating mode is selected as a function of the recorded temperature quantity.

7 Claims, 3 Drawing Sheets

VOLTAGE REGULATOR CIRCUIT

FIELD OF THE INVENTION

The present invention is directed to a circuit system for generating a stabilized power supply voltage and, in particular, to the voltage supply in a motor vehicle.

BACKGROUND INFORMATION

As vehicle electronic systems are being increasingly used to implement motor vehicle functions, it is becoming ever more important to protect the stability of the vehicle electrical systems from failure and from fluctuations in the power supply system. In this context, the current and voltage supply for the consumers of a motor vehicle places special demands on the voltage regulators employed, since the vehicle system voltage fluctuates within a very broad range in dependence upon the battery charge, the vehicle operation, and the ambient temperature. The fluctuation range of the vehicle system voltage is significantly affected by the connection of heavy consumers to the load. Thus, a considerable voltage drop can occur when the engine is started. In spite of these voltage fluctuations, it is necessary to ensure a constant current and voltage supply for the consumers. A regulated voltage that is constant to the greatest possible degree is needed, in particular, for the motor-vehicle control units.

To generate a constant power supply voltage, a low-voltage detection is provided, as described, for example, in German Patent No. 198 38 003. It can be used to prevent certain voltage-critical processes, such as EEPROM memory accesses. In this context, linear regulators or switching regulators having different operational ranges can be used as voltage transformers.

German Patent Application No. 199 17 204 describes a device in which an in-phase regulator is connected in parallel to a switching (switched-mode) regulator to generate a stabilized power supply voltage. The in-phase regulator and the switching regulator are dimensioned in such a way that at lower voltages, the in-phase regulator is active in controlling the voltage supply and, at the usually present higher voltages, the switching regulator is active in controlling the supply, this switching regulator switching itself off when the voltage drops too far. In the event of failure of one of the two regulators, the two parallel-connected regulators additionally facilitate delivery of a somewhat stabilized power supply voltage.

German Patent No. 40 15 351 discusses a current-supply device in which a linear regulator and a switching regulator are connected in parallel as voltage regulators. The regulators are activated as a function of the exceedance of limiting values constituted as predefined voltage values. By setting the limiting values, different operating modes of the voltage regulator can result.

German Patent Application No. 29 33 029 describes a power supply circuit for use in transmitters and receivers, where a high-current chopper-type voltage amplifier (regulator) and a low-current linear amplifier (regulator) are driven in parallel to generate a ripple-free output during the receiving phase and a stable voltage during the transmitting phase. In the process, the linear amplifier is only activated during the receiving phase and the chopper-type regulator only during the transmitting phase. By selecting the drive circuit control in this manner, emission by the chopper-type regulator that would otherwise be interfering during the receiving phase is avoided.

SUMMARY OF THE INVENTION

The present invention describes a circuit system for generating a stabilized power supply voltage, which, on the basis of a temperature quantity, selects an operating mode of a voltage regulator. In this context, it is provided, in particular, to apply the principles of the present invention to the supplying of voltage to electronic consumers in motor vehicles. During operation of the voltage regulator, a temperature quantity is recorded which is indicative of a quantity representing or influencing the operation of the circuit system. An essence of the present invention is that, during active operation, the voltage regulator may be operated in at least two operating modes, and the current operating mode is selected as a function of the recorded temperature quantity.

One embodiment of the present invention provides quite advantageously, in a first operating mode, for a first and/or a second regulator to be activated, while, in a second operating mode, for merely the second regulator to be activated.

Another embodiment of the present invention provides for the first regulator to be implemented by a linear regulator and the second regulator by a switching regulator.

Yet another embodiment of the present invention provides for first and second regulators present in the voltage regulator to be connected in parallel to one another. Besides enabling the two regulators to be switched or activated jointly or independently from one another, the parallel switching of both regulators reduces the probability of failure of the system since a voltage supply characterized by a reasonably stabilized power supply voltage is also ensured in the event of failure of one of the two regulators.

A particularly advantageous effect is attained for the present invention by recording the temperature quantity. By recording a temperature quantity representing the temperature at at least one component of the circuit system, it is possible to measure the heat loss that occurs during operation of the voltage regulator. Thus, it is conceivable that the temperature at the electronic components necessary for the switching operation, such as transistors, resistors, or circuit boards, is recorded, but also at non-electronic components, such as on the housing. A specific embodiment of the present invention is also conceivable where the current flow through the voltage regulator is measured, and, from this, the dissipation heat in the form of a temperature quantity may be inferred.

One advantageous embodiment of the present invention provides for the recorded temperature quantity to be compared to a predefined threshold value. In this context, the threshold value may correspond, for example, to a critical temperature quantity for operating the voltage regulator.

Any exceeding of the threshold value by the temperature quantity is advantageously recognized by the comparison operation. Thus, it is possible to ascertain, for example, when a critical temperature of the voltage regulator represented by the threshold value is exceeded. As a function of the comparison, in particular as a function of the recognized exceedance of the threshold value, it is provided to select a specific, predefined operating mode of the voltage regulator. One special specific embodiment provides for the first regulator to be deactivated and the second regulator to be activated in response to the temperature quantity exceeding the threshold value.

DETAILED DESCRIPTION

In the context of voltage regulation, to generate a stabilized supply voltage, in particular in a motor vehicle, substantial power losses can occur. These power losses are radiated in the form of dissipation heat, for example, when a linear regulator is used. For that reason, when working with customary linear regulators, the heat produced at the linear regulator during operation must be dissipated by using costly heat sinks, by employing a suitable, large type of construction, and or by expending a corresponding outlay for control. On the other hand, when a switching controller is used, much less dissipation heat is produced. However, the disadvantage entailed in using a switching regulator is that radiated interference results from the clocked activation mode of operation and possibly has a negative effect on other electronic components of the vehicle's electrical system. Therefore, to compensate for this radiated interference, to a certain degree, substantial outlay for shielding is required.

The present invention provides a switching system which activates two different regulators of a voltage regulator to ensure that a stabilized supply voltage is made available in a way that enables the advantages of the two regulators to be optimally utilized.

Figure 1:
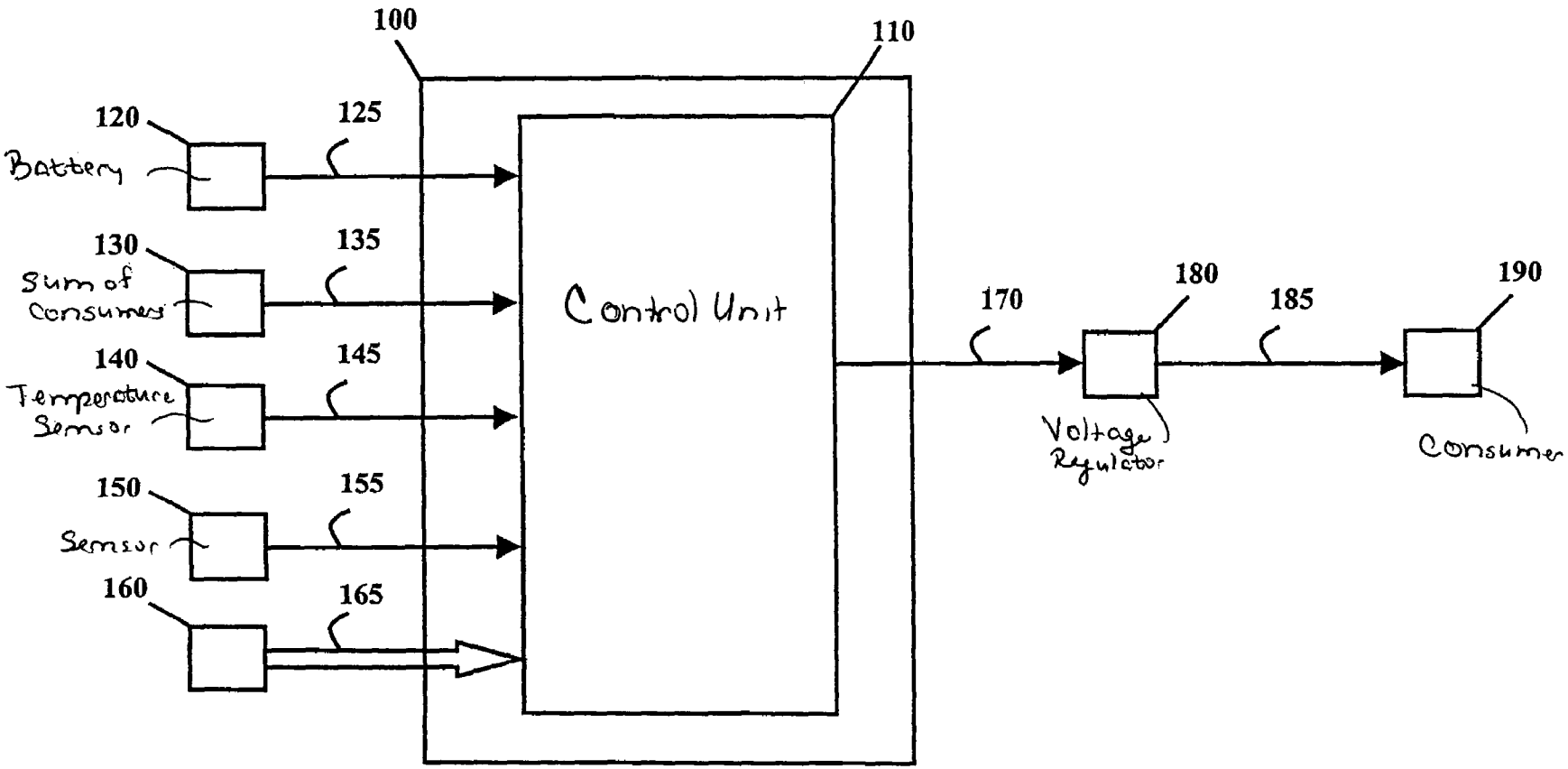
FIG. 1 schematically shows the circuit system in a block diagram.

A schematic representation of the voltage-regulation control is shown in a block diagram in FIG. 1. The parameters necessary for controlling the voltage regulator are recorded in a central unit 110 within block 100. In the process, a value for actual voltage $U_{actual}$ (125) from a battery 120 supplying the vehicle electrical system is input. Together with the regulated setpoint voltage $U_{setpoint}$ (135), which is requested as a sum of all consumers 130, $U_{actual}$ (125) represents the framework for the voltage-regulation control, in addition to representing the compensation of voltage fluctuations in the vehicle electrical system, for example due to consumers being connected and disconnected. As a measure of the power loss that has occurred, a temperature quantity $T_S$ (145) representing the temperature is recorded by an appropriate temperature sensor 140. It is merely for the sake of clarity that the present description is limited to one temperature sensor 140. However, it may easily be expanded to include a plurality of sensors. It is provided for the temperature to be recorded at locations which permit conclusions to be drawn with respect to the voltage regulator's response to temperature changes during operation. Thus, for example, the temperature may be measured directly at individual components such as transistors, heat sinks or circuit boards, but also at the housing of the voltage regulator. In addition, in block 110, a sensor 150 is queried. It provides information indicating whether, at the current regulation instant, radiated interference, as can arise during operation of a switching regulator, can lead to a critical situation in safety-related systems. If this sensor 150 ascertains that radiated interference has a disadvantageous effect on safety-related systems, then a flag $F_S$ (155) is set, i.e., $F_S=1$. Besides being generated by a special sensor 150, this flag $F_S$ (155) may, however, also be produced by every system 150 which, at times, is sensitive to radiated interference and is designed to avoid a negative influence caused by prolonged radiated interference. In another specific embodiment of the present invention, however, the need for reading in flag $F_S$ (155) is eliminated, since the switching regulator is activated merely for a short period of time, and the radiated interference is therefore kept within an acceptable limit.

The active regulation state of the voltage regulator is read in as last parameter 165 in block 110. This relates, above all, to the information indicating which of the two regulators is activated or deactivated, explicit state variables, such as the average fluctuation amplitude of the supply voltage, activation time of the individual regulators, etc. absolutely being able to be read in.

Figure 2:
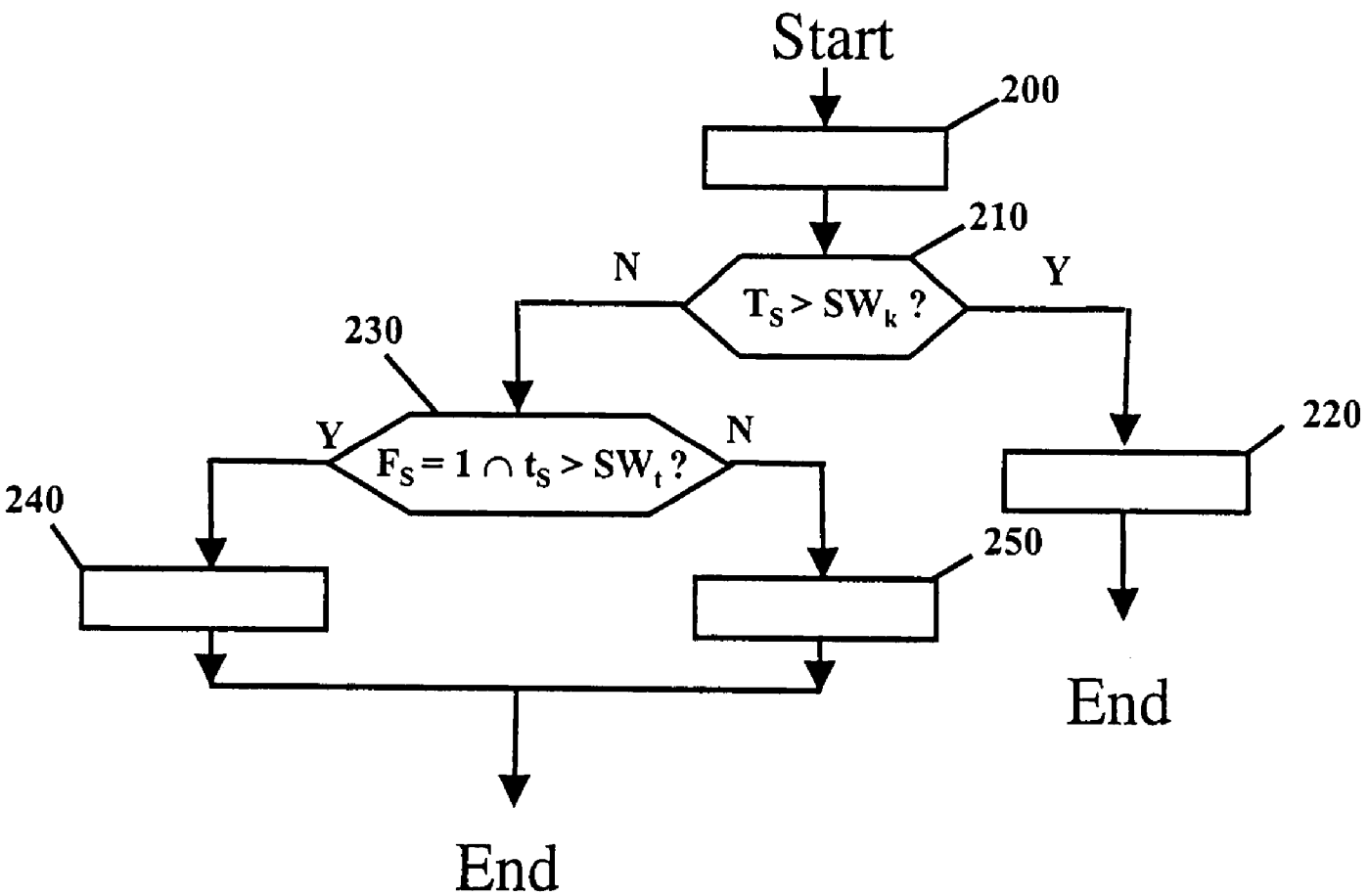
FIG. 2 shows a flow chart depicting the functional sequence for selecting the operating mode of the voltage regulator.

By evaluating the input data (125, 135, 145, 155, 165) using the method illustrated in FIG. 2 for determining the connection or activation, circuit requirements 170 made of voltage regulator 180 are calculated. The thus selected operating mode (selection between activating the linear regulator and/or the switching regulator) subsequently enables the regulated setpoint voltage $U_{setpoint,regulated}$ (185) to be generated for supplying consumers 190.

The flow chart in FIG. 2 illustrates the procedure used in determining the operating mode of the voltage regulator within block 110. In this context, the present exemplary embodiment provides for two different operating modes, which are distinguished in that, in the first operating mode, both regulators, i.e., linear regulators and switching regulators, may be activated both individually as well as jointly and, in the second operating mode, merely the switching regulator is activated.

Following the start of the algorithm, in a first step 200, parameters $T_S$ (145), $F_S$ (155), as well as current activation time $t_S$ (165) of the switching regulator are read in from the corresponding sensors or systems. Subsequently thereto, in step 210 in accordance with $$T_S > SW_K$$

it is verified that temperature quantity $T_S$ (145) has exceeded a threshold value $SW_K$. In this context, threshold value $SW_K$ may represent a critical temperature at which the performance reliability of the linear regulator may no longer be ensured or may only be ensured to a limited extent. This may be due, for example, to the fact that the structural measures for dissipating the heat loss at the linear regulator are specified only up to a specific quantity of heat.

If it is ascertained that threshold value $SW_K$ is exceeded in step 210, then, in step 220, the switching regulator is activated, i.e., switched on, and the linear regulator is deactivated, i.e., switched off, before the algorithm is ended. This operating mode ensures the functioning of the voltage regulator even at high temperatures, since it is possible to lower the temperature of the voltage regulator by the reduced dissipation heat, as results when working with the switching regulator. Due to the high threshold value, the switching regulator is activated relatively infrequently, so that one can accept the increase in radiated interference in such situations.

However, if the recorded temperature quantity $T_S$ (145) is below threshold value $SW_K$, then, in step 230, flag $F_S$ (155) and the switching regulator's activation time $t_S$ (165) that is active up to that point are queried. Then, in step 230, by applying $$t_S > SW_t$$

it is checked whether the switching regulator had already been activated for a predefined maximum time $SW_t$. If flag $F_S$ (155) is in the unset state, i.e., $F_S$=0, then this signals a situation that is not critical to systems 150 monitored by the flag with regard to a possible radiated interference, and the algorithm is further processed at step 250. In the same way, reference is made to step 250 when, at the same time, the activation time of switching regulator $t_S$ is below predefined time $SW_t$ and, therefore, indicates an acceptable possible adverse influence on other systems by the operation of the switching regulator. Consequently, without deactivating the switching regulator, the linear regulator for regulating voltage is switched in as well. If, however, by a set flag $F_S$=1, a situation is indicated at one of monitored systems 150, which is susceptible to radiated interference, or if time $t_S$ is greater than the maximum activation time $SW_t$ of the switching regulator, then, in step 240, following activation (connection to load) of the linear regulator, the switching regulator is deactivated. The algorithm is subsequently ended, in the same way as after step 250.

The above described algorithm may be begun anew and run through in regular intervals at arbitrary or predefined points in time.

Figure 3:
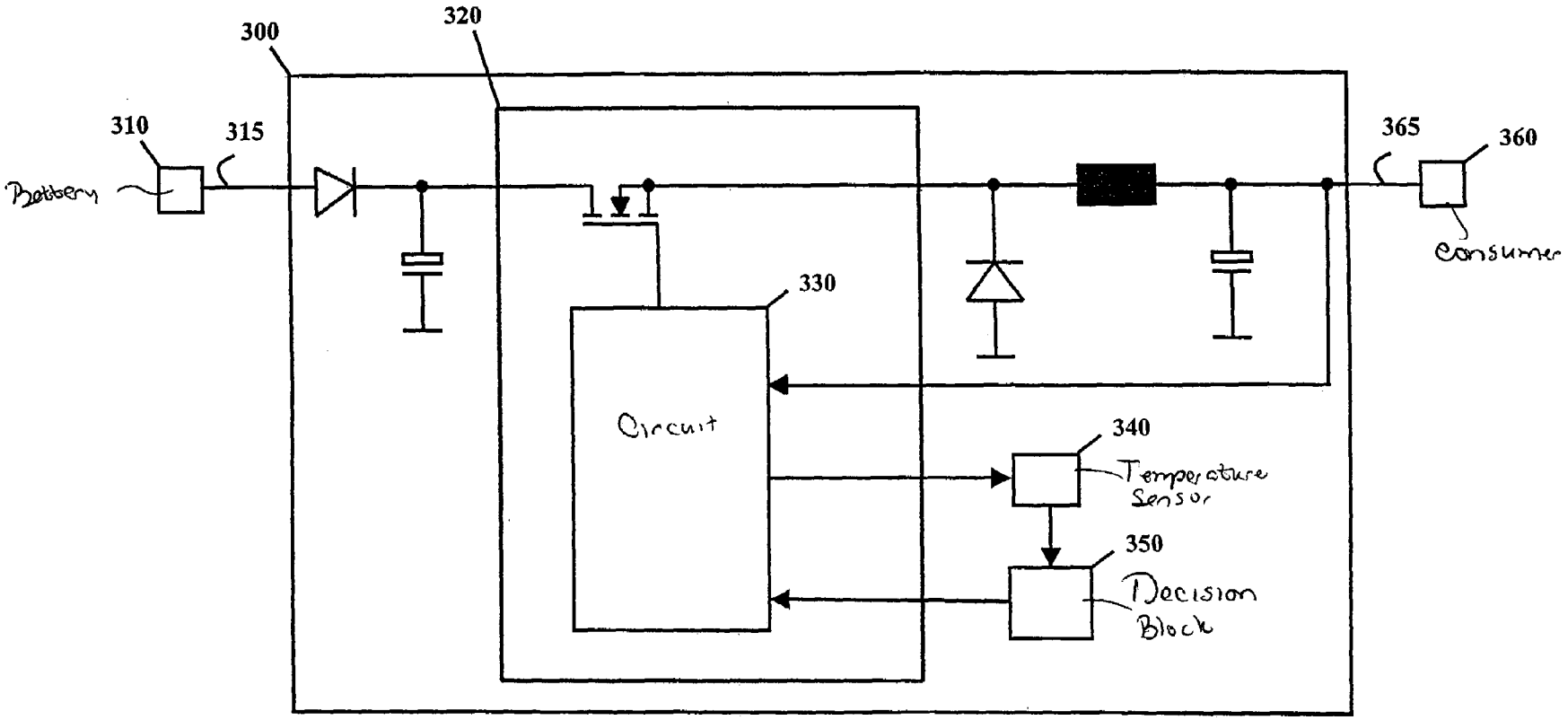
FIG. 3 illustrates a specific circuit system for implementing the present invention.

FIG. 3 shows one possible implementation of the present invention by way of example. In this context, actual supply voltage $U_{actual}$ (125) coming from battery 310 is input into voltage regulator 300. During operation of voltage regulator 300, temperature $T_S$ (145) is recorded by a temperature sensor 340 and routed to block 350. Within block 350, a decision is made with regard to the (switching) allocation of the voltage regulation on the basis of input parameters $T_S$ (145), $F_S$ (155) and 165. If a switchover is to be made between the linear regulator and the switching regulator, then drive circuit 330 activates transistor 320 of the voltage regulator accordingly. Subsequent to regulation, regulated setpoint voltage $U_{setpoint,regulated}$ (365) generated by voltage regulator 300 is routed to consumer 360.

The circuit system as shown in FIG. 3 may be used, for example, for supplying a control unit in a motor vehicle. By using a circuit system of this kind to generate a stabilized power supply voltage, it is possible to supply voltage-sensitive consumers, such as personal computers in the vehicle, electro-hydraulic braking systems, etc.

What is claimed is:

1. A circuit system for generating a stabilized supply voltage comprising:

a voltage regulator having at least two operating modes and including a first regulator and a second regulator, wherein:

at least one temperature quantity is recorded which at least one of represents and influences an operation of the circuit system, an operating mode is selected as a function of the temperature quantity, in a first operating mode, at least one of the first and second regulators is activated, in a second operating mode, the second regulator is activated;

a comparison element for comparing the recorded temperature quantity to a predefined threshold value; and means for recognizing an exceeding of the threshold value by the temperature quantity and, as a function of the recognized exceedance, for deactivating the first regulator and activating the second regulator.

2. The circuit system according to claim 1, wherein the circuit system is for electronic consumers in motor vehicles.

3. The circuit system according to claim 1, wherein the first regulator is a linear regulator.

4. The circuit system according to claim 1, wherein the second regulator is a switching regulator.

5. The circuit system according to claim 1, wherein the first regulator is connected in parallel to the second regulator.

6. The circuit system according to claim 1, wherein the temperature quantity represents a temperature at at least one component of the circuit system.

7. The circuit system according to claim 1, wherein the temperature quantity represents a current flow and, thus, a temperature at the voltage regulator.

* * * * *